US007180497B2

(12) United States Patent
Lee et al.

(10) Patent No.: US 7,180,497 B2
(45) Date of Patent: Feb. 20, 2007

(54) APPARATUS AND METHOD FOR DRIVING LIQUID CRYSTAL DISPLAY

(75) Inventors: Seok Woo Lee, Seoul (KR); Jin Kyoung Song, Kyoungsangbuk-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 362 days.

(21) Appl. No.: 10/139,355

(22) Filed: May 7, 2002

(65) Prior Publication Data

US 2003/0132907 A1 Jul. 17, 2003

(30) Foreign Application Priority Data

Jan. 14, 2002 (KR) ..... P2002-002090

(51) Int. Cl.
*G09G 3/36* (2006.01)

(52) U.S. Cl. ..... 345/98; 345/99

(58) Field of Classification Search ..... 345/87, 345/94, 98, 99, 100, 204, 211
See application file for complete search history.

(56) References Cited

U.S. PATENT DOCUMENTS

| | | | | |
|---|---|---|---|---|
| 5,170,158 A | | 12/1992 | Shinya | |
| 5,288,938 A | * | 2/1994 | Wheaton | 84/600 |
| 5,412,397 A | * | 5/1995 | Kanatani et al. | 345/99 |
| 5,510,748 A | | 4/1996 | Erhart et al. | |
| 5,579,027 A | * | 11/1996 | Sakurai et al. | 345/100 |
| 5,781,167 A | * | 7/1998 | Rebeschi et al. | 345/76 |
| 5,903,250 A | * | 5/1999 | Lee et al. | 345/100 |
| 6,097,362 A | * | 8/2000 | Kim | 345/87 |
| 6,268,841 B1 | | 7/2001 | Cairns et al. | |
| 6,373,478 B1 | * | 4/2002 | Steffensmeier | 345/204 |

FOREIGN PATENT DOCUMENTS

| | | |
|---|---|---|
| DE | 19821914 | 11/1998 |
| EP | 0 483 972 | 11/1996 |
| EP | 0 929 064 | 7/1999 |
| EP | 0 929 0064 | 7/1999 |
| EP | 0 938 074 | 8/1999 |

OTHER PUBLICATIONS

"New Digital Data–Line Circuit for TFT–LCD Driving", H. Tsuchi, et al., Society for Information Display, International Symposium, Digest of Technical Papers, vol. 27, pp. 251–254, San Diego Convention Center, San Diego, CA, May 12–17, 1996.
Copy of German Patent Office dated Aug. 8, 2005.
Copy of communication from Chinese Patent Office dated Dec. 30, 2005.

* cited by examiner

*Primary Examiner*—Kent Chang
(74) *Attorney, Agent, or Firm*—McKenna Long & Aldridge LLP

(57) ABSTRACT

A data driving apparatus and method for a liquid crystal display wherein a digital to analog converter part is driven on a time-division basis to increase the number of output channels of a data driving IC without excessively increasing a chip area or by reducing a chip area in comparison to the existing chip area, thereby reducing the number of data driving IC's and TCP's. In the apparatus, a multiplexor part performs a time-division of input pixel data to output the time-divided pixel data. A digital to analog converter part converts the pixel data from the multiplexor part into pixel voltage signals. A demultiplexor part selectively supplies the pixel voltage signals from the digital to analog converter part to a plurality of output lines of the demultiplexor part. A sampler and holder part samples and holds the pixel voltage signals from the demultiplexor part to output the sampled and held pixel voltage signals to a plurality of data lines of the liquid crystal display.

14 Claims, 8 Drawing Sheets

APPARATUS AND METHOD FOR DRIVING LIQUID CRYSTAL DISPLAY

This application claims the benefit of the Korean Application No. P2002-02090 filed on Jan. 14, 2002, which is hereby incorporated by reference.

BACKGROUND OF THE INVENTION

1. Field of the Invention

The present invention relates to a liquid crystal display, and more particularly, to an apparatus and method for driving a liquid crystal display. Although the present invention is suitable for a wide scope of applications, it is particularly suitable for reducing the number of digital to analog converter integrated circuits and data carrier packages.

2. Discussion of the Related Art

Generally, a liquid crystal display (LCD) controls light transmittance of the liquid crystal by using an electric field in displaying an image. To this end, the LCD includes a liquid crystal display panel having liquid crystal cells arranged in a matrix form, and a driving circuit for driving the liquid crystal display panel.

In the liquid crystal display panel, a plurality of gate lines and data lines are arranged in such a manner to cross each other. The liquid crystal cell is positioned at every area where the gate lines cross the data lines. The liquid crystal display panel is provided with a pixel electrode and a common electrode to apply an electric field to each of the liquid crystal cells. Each pixel electrode is connected to one of data lines through source and drain electrodes of a thin film transistor as a switching device. The gate electrode of the thin film transistor is connected to one of the gate lines allowing a pixel voltage signal to be applied to the pixel electrodes for each line.

The driving circuit includes a gate driver for driving the gate lines, a data driver for driving the data lines, and a common voltage generator for driving the common electrode. The gate driver sequentially applies a scanning signal to the gate lines to sequentially drive the liquid crystal cells on the liquid crystal display panel line by line. The data driver applies a data voltage signal to each of the data lines whenever the gate signal is applied to one of the gate lines. The common voltage generator applies a common voltage signal to the common electrode. Accordingly, the LCD controls light transmittance by an electric field applied between the pixel electrode and the common electrode in accordance with the data voltage signal for each liquid crystal cell, thereby displaying a picture. The data driver and the gate driver are integrated into a plurality of integrated circuits (IC's). The integrated data driver IC and gate driver IC are mounted on a tape carrier package (TCP) to be connected to the liquid crystal display panel by a tape automated bonding (TAB) system, or mounted on the liquid crystal display panel by a chip on glass (COG) system.

FIG. 1 schematically shows a data driving apparatus in a conventional LCD.

Referring to FIG. 1, the data driving apparatus includes data driving IC's 4 connected to a liquid crystal display panel 2 through TCP's 6, and a data printed circuit board (PCB) 8 connected to the data driving IC's 4 through the TCP's 6.

The data PCB 8 plays a role to receive various control signals from a timing controller (not shown), data signals and driving voltage signals from a power generator (not shown) and interface to the data driving IC's 4. Each of the TCP 6 is electrically connected to a data pad provided at the upper portion of the liquid crystal display panel 2 and an output pad provided at each data PCB 8. The data driving IC's 4 convert digital pixel data into analog pixel signals to supply to data lines on the liquid crystal display panel 2.

To this end, as shown in FIG. 2, each of the data driving IC's 4 includes a shift register part 14 for applying a sequential sampling signal, a latch part 16 for sequentially latching a pixel data VD in response to the sequential sampling signal and outputting the latched pixel data VD at the same time, a digital to analog converter (DAC) 18 for converting the latched pixel data VD from the latch part 16 into a pixel signal, and an output buffer part 26 for buffering and outputting the pixel signal from the DAC 18. Further, the data driving IC 4 includes a signal controller 10 for interfacing various control signals from a timing controller (not shown) and the pixel data VD, and a gamma voltage part 12 for supplying positive and negative gamma voltages required in the DAC 18. Each data driving IC 4 having a configuration as mentioned above drives n data lines D1 to Dn.

The signal controller 10 controls various control signals (i.e., SSP, SSC, SOE, REV, and POL, etc.) and the pixel data VD outputs to the corresponding parts. The gamma voltage part 12 further divides and outputs a plurality of gamma reference voltages generated from a gamma reference voltage generator (not shown) for each gray level.

There are n/6 shift registers included in the shift register part 14 sequentially shifting a source start pulse SSP from the signal controller 10 in response to a source sampling clock signal SSC to output as a sampling signal. The latch part 16 sequentially samples and latches the pixel data VD from the signal controller 10 by a certain unit in response to the sampling signal from the shift register part 14. To this end, the latch part 16 consists of n latches for latching n pixel data VD, each of which has a size corresponding to the bit number (i.e., 3 bits or 6 bits) of the pixel data VD. Particularly, the timing controller (not shown) simultaneously outputs the pixel data VD divided into even-numbered pixel data VDeven and odd-numbered pixel data VDodd through each transmission line so as to reduce the transmission frequency. Each of the even-numbered data VD even and the odd-numbered data VDodd includes red(R), green(G), and blue(B) pixel data. Thus, the latch part 16 simultaneously latches the even-numbered pixel data VDeven and the odd-numbered pixel data VDodd applied through the signal controller 10, that is, 6 pixel data for each sampling signal.

Subsequently, the latch part 16 simultaneously outputs n pixel data VD in response to a source output enable signal SOE from the signal controller 10. In this case, the latch part 16 restores the pixel data VD modulated in such a manner to have a reduced transition bit number in response to a data inversion selecting signal REV and then to output the restored pixel data VD having a reduced transition bit number. This is because the pixel data VD having a transited bit number greater than the reference value is supplied such that it is modulated to have a reduced transition bit number in order to minimize electromagnetic interference (EMI) upon data transmission from the timing controller.

The DAC 18 converts the pixel data VD from the latch part 16 into positive and negative pixel signals at the same time and outputs the converted pixel data VD. To this end, the DAC 18 includes a positive (P) decoding part 20 and a negative (N) decoding part 22 commonly connected to the latch part 16, and a multiplexor (MUX) 24 for selecting output signals of the P and N decoding parts 20 and 22.

There are n P decoders in the P decoding part 20 converting n pixel data simultaneously inputted from the latch part 16 into positive pixel signals by using positive gamma voltages from the gamma voltage part 12. Similarly, the N decoding part 22 having n N decoders simultaneously converts n pixel data inputted from the latch part 16 into negative pixel signals by using negative gamma voltages from the gamma voltage part 12. The multiplexor 24 responds to a polarity control signal POL from the signal controller 10 to selectively outputs the positive pixel signals from the P decoding part 20 or the negative pixel signals from the N decoding part 22.

The output buffer part 26 having n output buffers consists of voltage followers connected to the n data lines D1 to Dn in series. Such output buffers performs a buffering of the pixel voltage signals from the DAC 18 and supplies to the data lines D1 to Dn.

FIG. 3 illustrates a transmission path of a portion of the pixel data within the data driving IC 4 shown in FIG. 3.

In FIG. 3, latches 17 of the latch part 17 output 9 pixel data to 9 DAC's 19 constructing the DAC part 18 to convert the pixel data into pixel voltage signals. The pixel voltage signals are applied to the first to ninth data lines DL1 to DL9 through buffers 27 of the output buffer part 26.

As described above, each of the conventional data driving IC's 4 should have n DAC's, each of which includes a P decoder, an N decoder and a multiplexor, so as to drive n data lines DL1 to DLn. Thus, the data driving IC has a complex configuration causing a relatively high manufacturing cost. Accordingly, it is necessary to reduce the number of data driving IC's in order to lower a manufacturing cost.

In order to reduce the number of data driving IC's, there has been considered a scheme of increasing the number of data lines that can be driven by the data driving IC, that is, the number of output channels. However, since the number of DAC's having a complex configuration is increased in accordance with the increase in the number of driving channels of the data driving IC to enlarge a chip area, a cost of the TCP's proportional to the chip area is increased and their integration becomes difficult. As a result, manufacturing cost is increased and yield is likely to be reduced.

SUMMARY OF THE INVENTION

Accordingly, the present invention is directed to an apparatus and method for driving a liquid crystal display that substantially obviates one or more of problems due to limitations and disadvantages of the related art.

Another object of the present invention is to provide an apparatus and method for driving a liquid crystal display wherein a digital to analog converter part is driven on a time-division basis to increase the number of output channels of the data driving IC while the chip area is not greatly increased or reduced in comparison to the existing chip area, thereby reducing the number of data driving IC's and TCP's.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a data driving apparatus for a liquid crystal display includes a multiplexor part having at least one multiplexor for performing a time-division of input pixel data to output the time-divided pixel data, a digital to analog converter part having at least one digital to analog converter for converting the time-divided pixel data from the multiplexor part into pixel voltage signals, a demultiplexor part having at least one demultiplexor for selectively supplying the pixel voltage signals from the digital to analog converter part to a plurality of output lines of the demultiplexor part, and a sampler and holder part having at least one sampler and holder for sampling and holding the pixel voltage signals from the demultiplexor part to output the sampled and held voltage signals to a plurality of data lines of the liquid crystal display.

In the data driving apparatus, the multiplexor part includes at least 2 n/3 multiplexors (wherein n is an integer) to perform an at least 2 n/3 time-division of at least 2 n pixel data, the digital to analog converter part includes at least 2 n/3 digital to analog converters to convert at least 2 n/3 pixel data into pixel voltage signals, and the demultiplexor part includes at least 2 n/3 multiplexors to selectively supply each 2 n/3 pixel voltage signals to at least 2 n output lines.

The data driving apparatus further includes a shift register part for sequentially generating sampling signals, a latch part for sequentially latching the at least 2 n pixel data by a unit in response to the sampling signals to simultaneously output the latched data to the multiplexor part, and a buffer part for buffering the pixel voltage signals from the sampler and holder array to output them to the plurality of data lines.

Each digital to analog converter includes a positive part for converting the pixel data into positive voltage signals, a negative part for converting the pixel data into negative voltage signals, and a multiplexor for selecting outputs of the positive and negative parts.

Each multiplexor includes first to third switching devices for performing a time-division of at least three pixel data to output the time-divided pixel data to one of the digital to analog converters in response to first to third switching control signals, respectively, and each demultiplexor includes fourth to sixth switching devices for selectively supplying the pixel voltage signals from the digital to analog converter part to at least three output lines in response to the first to third switching control signals, respectively.

The sampler and holder part includes at least 2 n sampler and holders connected to at least 2 n output lines of the demultiplexor part, each of which includes first and second sampling switches connected in parallel to each output line of the demultiplexor part, first and second capacitors for charging the pixel voltage signals passing through the sampling switches, and first and second holding switches for holding the pixel voltage signals charged in the first and second capacitors and discharging the held pixel voltage signals into the data lines.

The first sampling switch for sampling the pixel voltage signals to be charged in the first capacitor and the second holding switch for holding and discharging the pixel voltage signals charged in the second capacitor are driven in response to the first switching control signal, and the second sampling switch for sampling the pixel voltage signals to be charged in the second capacitor and the first holding switch for holding and discharging the pixel voltage signals charged in the first capacitor are driven in response to the second switching control signal having a logical state inverted with respect to the first switching control signal.

In another aspect of the present invention, a data driving method for a liquid crystal display includes performing a time-division of pixel data inputted from a multiplexor part to apply the time-divided pixel data, converting the time-divided pixel data from the multiplexor part into a plurality of pixel voltage signals, selectively supplying the pixel voltage signals from a digital to analog converter part to a plurality of output lines of the multiplexor part, and sampling and holding the pixel voltage signals from the demultiplexor part at a sampler and holder part to output the sampled and held pixel voltage signals to a plurality of data lines of the liquid crystal display.

The data driving method further includes sequentially generating sampling signals, sequentially latching at least 2 n pixel data by a unit in response to the sampling signals to simultaneously output the latched data to the multiplexor part, and buffering the pixel voltage signals from the sampler and holder part to output the buffered pixel voltage signals to at least 2 n data lines.

In the data driving method, performing a time-division of the pixel data includes performing a time-division of at least 2 n pixel data into at least three regions in response to first to third switching control signals, and selectively supplying the pixel voltage signals to the plurality of output lines includes selectively supplying the pixel voltage signals to at least three output lines in response to the first to third switching control signals.

Herein, the sampler and holder part has at least one sampler and holder including first and second sampling switches, first and second capacitors, and first and second holding switches. Sampling and holding the pixel voltage signals includes allowing the first sampling switch to sample the pixel voltage signals from the demultiplexor part to be charged in the first capacitor in one horizontal period and, at the same time, allowing the second holding switch to discharge the pixel voltage signals in the previous horizontal period charged in the second capacitor into the corresponding data line, and allowing the second sampling switch to sample the pixel voltage signals from the demultiplexor part to be charged in the second capacitor and, at the same time, allowing the first holding switch to discharge the pixel voltage signals in the previous horizontal period charged in the first capacitor to the corresponding data line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

Figure 1:
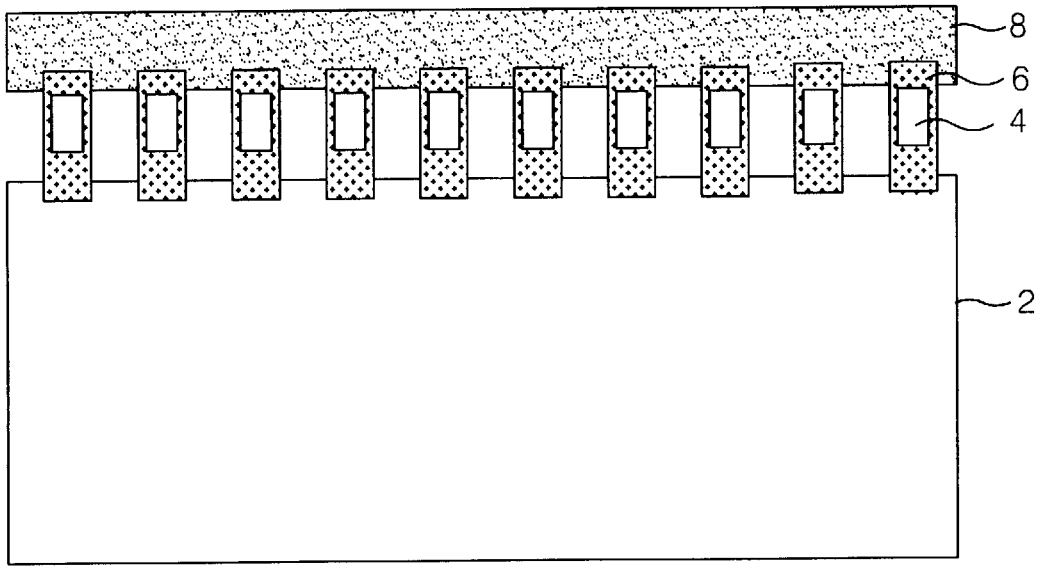
FIG. 1 CONVENTIONAL ART
FIG. 1 is a schematic view showing a data driving apparatus of a conventional liquid crystal display.
Figure 2:
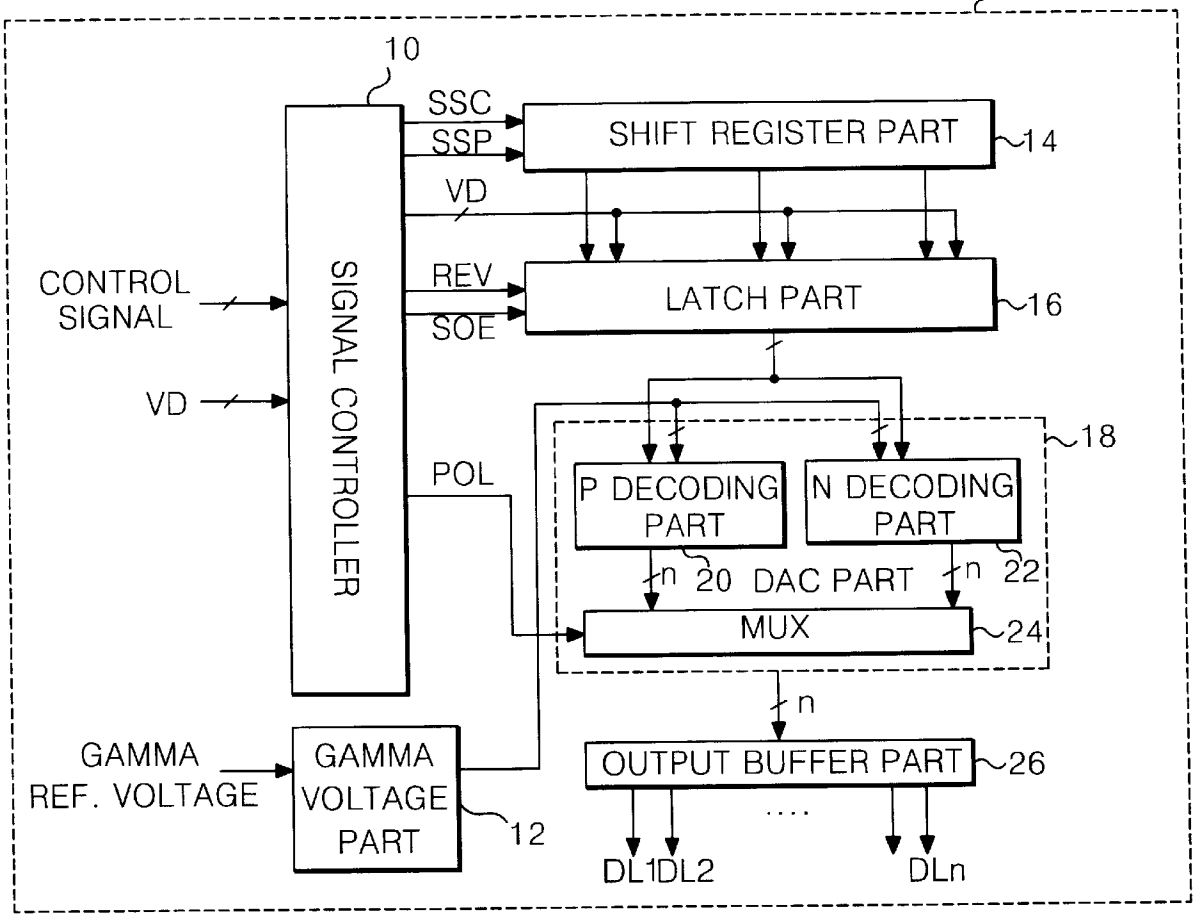
FIG.2 CONVENTIONAL ART
FIG. 2 is a detailed block diagram showing a configuration of the data driving integrated circuit in FIG. 1.
Figure 3:
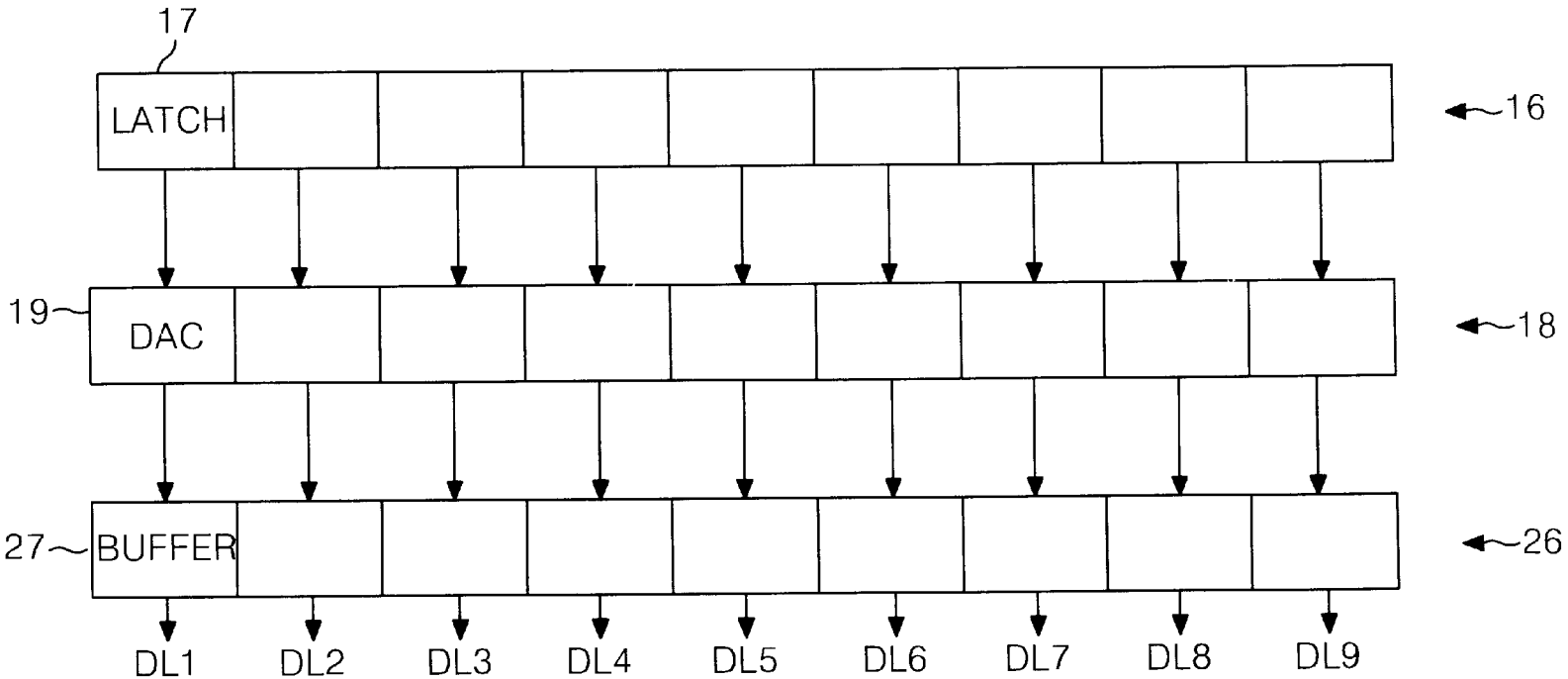
FIG.3 CONVENTIONAL ART
FIG. 3 illustrates a transmission path of a portion of data within the data driving integrated circuit shown in FIG. 2.
Figure 4:
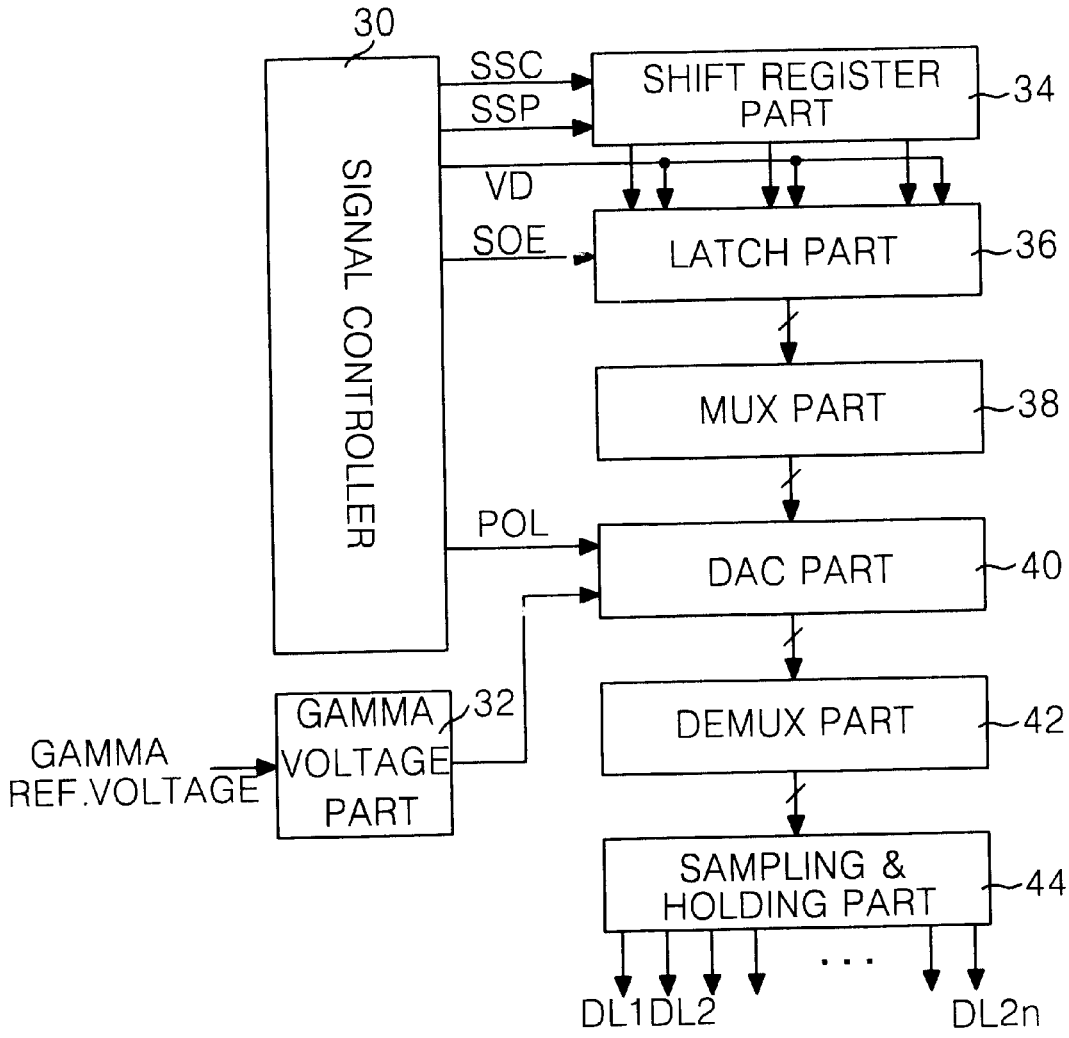
FIG. 4 is a block diagram showing a configuration of a data driving integrated circuit of a liquid crystal display according to the present invention.

FIG. 4 is a block diagram showing a configuration of a data driving apparatus of a liquid crystal display according to he present invention.

Referring to FIG. 4, the data driving apparatus includes a shift register part 34 for applying sequential sampling signals, a latch part 36 for sequentially latching pixel data VD in response to the sampling signals and outputting the latched pixel data at the same time, a multiplexor part 38 for performing a time-division of the pixel data VD from the latch part 36, a digital to analog converter (DAC) part 40 for converting the pixel data VD from the multiplexor part 38 into pixel voltage signals, a demultiplexor part 42 for performing a time-divisional driving of output lines to apply the pixel voltage signals from the DAC part 40, and a sampling and holding part 44 for sampling and holding the pixel voltage signals inputted from the demultiplexor part 38 to simultaneously supply to the data lines DL1 to DL2*n*. Further, the data driving apparatus includes a signal controller 30 for interfacing various control signals generated from a timing controller (not shown) and the pixel data VD, and a gamma voltage part 32 for supplying positive and negative gamma voltages to the DAC part 40. The data driving apparatus having a configuration as mentioned above may be integrated into a single data driving IC to drive 2 n data lines DL1 to DL2*n*, which are twice the data lines that can be driven by the conventional data driving IC.

The signal controller 30 controls various control signals (i.e., SSP, SSC, SOE, REV, and POL, etc.) and the pixel data VD to supply to the corresponding parts. The gamma voltage part 32 further divides a plurality of gamma reference voltages generated from a gamma reference voltage generator (not shown) for each gray level and then outputs the divided gamma reference voltages.

A plurality of shift registers included in the shift register part 34 sequentially shift a source start pulse SSP generated from the signal controller 30 in response to a source sampling clock signal SSC to output as a sampling signal.

Figure 5:
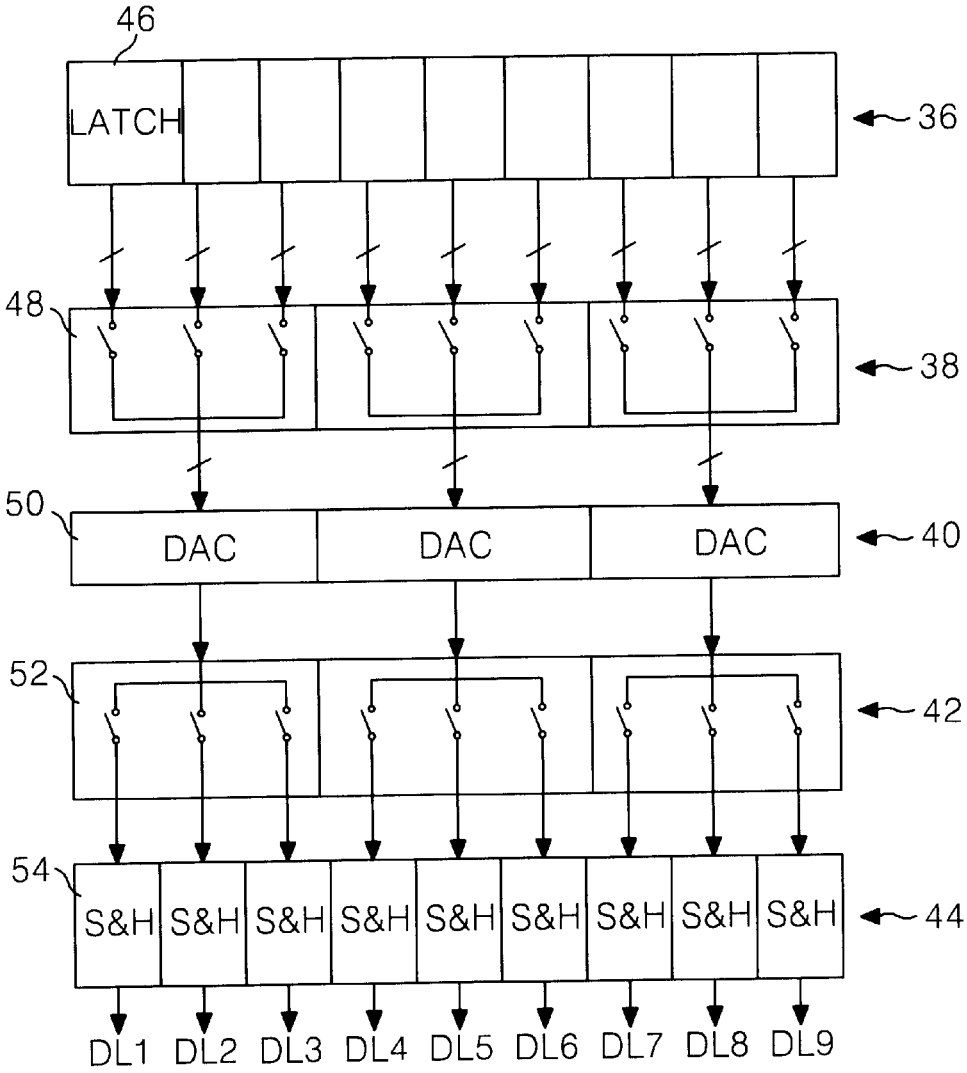
FIG. 5 illustrates a transmission path of a portion of data within the data driving integrated circuit shown in FIG. 4.

The latch part 36 sequentially samples the pixel data VD outputted from the signal controller 30 by a certain unit in response to the sampling signal from the shift register part 34 to latch the sampled pixel data. To this end, the latch part 36 consists of 2 n latches 46 for latching 2 n pixel data VD as shown in FIG. 5, each of which has a size corresponding to the bit number (i.e., 3 bits or 6 bits) of the pixel data VD. The latch part 36 simultaneously latches even-numbered pixel data VDeven and odd-numbered pixel data VDodd applied through the signal controller 30, that is, 6 pixel data for each sampling signal. Subsequently, the latch part 36 simultaneously outputs the latched 2 n pixel data VD in response to a source output enable signal SOE from the signal controller 30. In this case, the latch part 36 restores the pixel data VD modulated in such a manner to have a reduced transition bit number in response to a data inversion selecting signal REV and then outputs the restored pixel data having a reduced transition bit number.

The multiplexor part 38 performs a time-division of the 2 n pixel data inputted from the latch part 36 to output the time-divided pixel data. When the 2 n pixel data are time-divided into three regions, the multiplexor part 38 includes 2 n/3 multiplexors 48 connected to each three latches 46, as shown in FIG. 5. Each of the multiplexors 48 performs a time-division of the pixel data inputted from each three latches 46 to sequentially supply to one output line. In other words, the multiplexor part 36 performs a 2 n/3 time-division of the 2 n pixel data inputted from the latch part 36 to output the time-divided pixel data to the DAC part 40.

The DAC part 40 converts the pixel data VD from the multiplexor part 38 into positive and negative pixel voltage signals, and selectively outputs the positive and negative pixel voltage signals in response to a polarity control signal POL. To this end, the DAC part 40 consists of 2 n/3 DAC's 50 which are the same number as the multiplexors 48, as shown in FIG. 5. Each of the DAC's 50 includes a positive (P) decoder and a negative (N) decoder that are commonly connected to the multiplexor 48, and a multiplexor for selecting output signals of the P and N decoders. The P decoder converts the pixel data into positive pixel voltage signals by using positive gamma voltages generated from the gamma voltage part 34. The N decoder converts the pixel data into negative pixel voltage signals by using negative gamma voltages from the gamma voltage part 34. The multiplexor responds to the polarity control signal POL from the signal controller 32 to selectively output the positive pixel voltage signals or the negative pixel voltage signals.

The demultiplexor part 42 performs a time-divisional driving of the output lines to selectively apply the pixel voltage signals from the DAC part 40. To this end, the demultiplexor part 42 includes 2 n/3 demultiplexors, which are the same number as the DAC's 50, as shown in FIG. 5. Each of the demultiplexors 52 performs a time-divisional driving of three output lines to selectively apply the pixel voltage signals from the DAC 50. In other words, the demultiplexor part 42 sequentially outputs each 2 n/3 pixel voltage signal inputted from the DAC part 40 to the sampler and holder part 44 through different output lines.

The sampler and holder part 44 samples and holds the pixel voltage signals from the demultiplexor part 42 and then simultaneously outputs to the data lines DL1 to DL2*n*. To this end, the sampler and holder part 44 consists of 2 n samplers and holders 54, which are the same number as the number of the data lines DL1 to DL2*n*, as shown in FIG. 5. Each of the samplers and holders 54 samples and holds the pixel voltage signals inputted with a time difference from the demultiplexor 52 and then simultaneously outputs to the data lines DL1 to DL2*n*. In other words, the sampler and holder part 44 samples and holds each 2 n/3 pixel voltage signals inputted from the demultiplexor part 42 and, if all the 2 n pixel voltage signals have been sampled, then simultaneously outputs the pixel voltage signals to the $1^{st}$ to (2 n)th data lines DL1 to DL2*n*.

Figure 6:
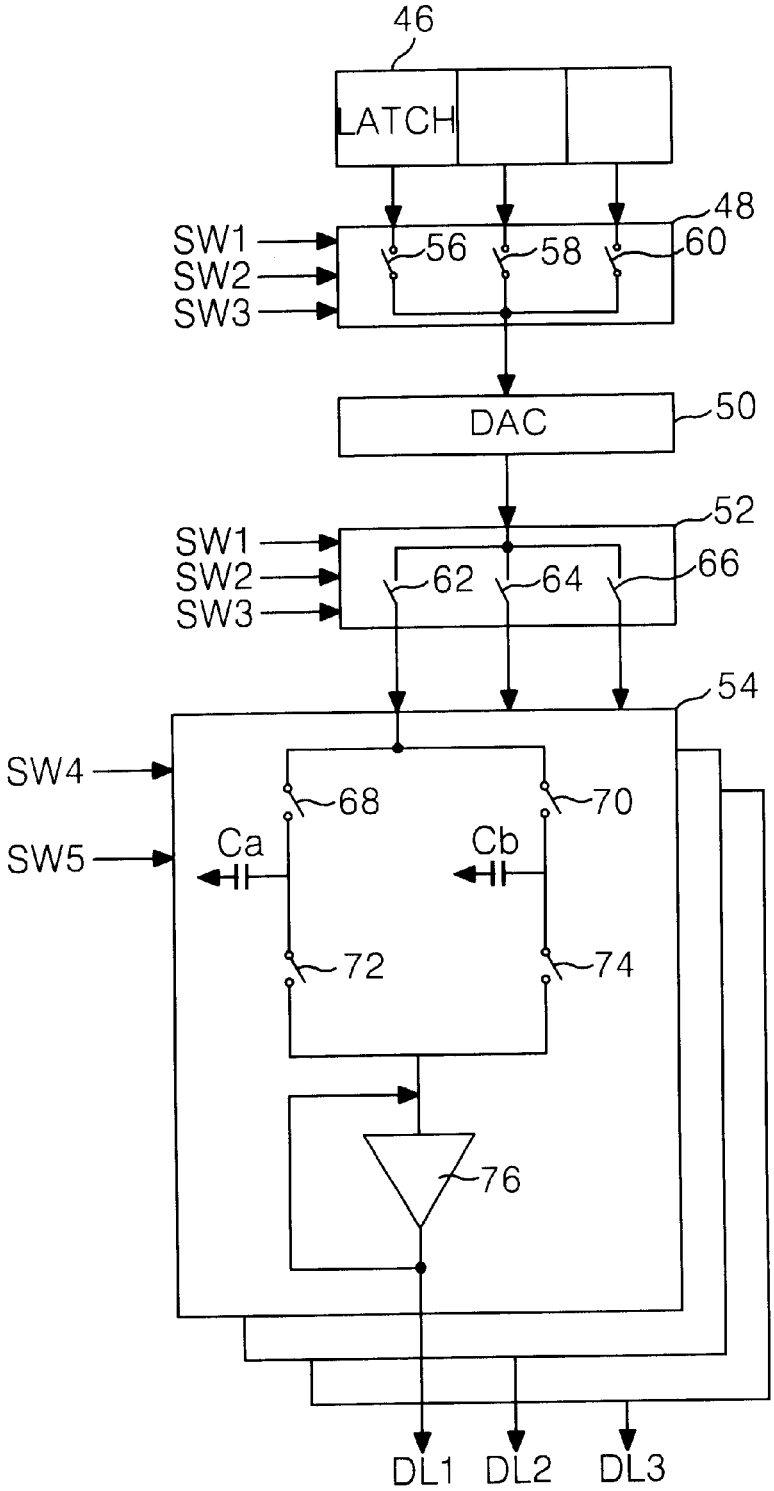
FIG. 6 illustrates a transmission path of a data having a detailed configuration of the sampler and holder shown in FIG. 5.
Figure 7:
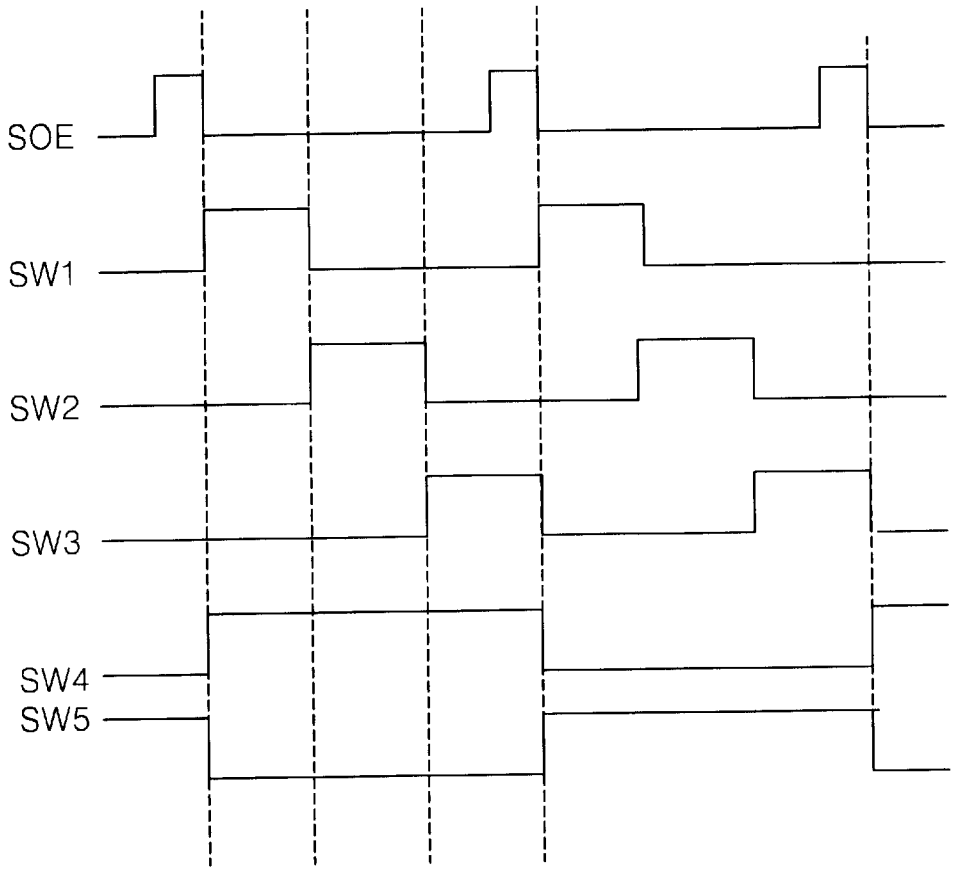
FIG. 7 is a waveform diagram of the switch control signals for controlling the switches shown in FIG. 6.

FIG. 6 illustrates a transmission path of three red(R), green(G), and blue(B) pixel data within the data driving IC shown in FIG. 5. FIG. 7 is a waveform diagram of the control signals for controlling driving of each part shown in FIG. 6.

In FIG. 6, each of the three latches 46 responds to an output enable signal SOE inputted through the signal controller 30, shown in FIG. 4, from the timing controller (not shown) to output the R, G, and B pixel data to the multiplexor 48. The output enable signal SOE is commonly applied to the latches 46 for each one horizontal period 1H, as shown in FIG. 7.

The multiplexor 48 performs a time-division of the R, G, and B pixel data inputted from the three latches 46 to sequentially supply the time-divided pixel data to a single DAC 50. To this end, the multiplexor 48 includes first to third switches 56, 58, and 60, each of which has an input line connected to each of the three latches 46 and an output line commonly connected to the DAC 50. The first to third switches 56, 58, and 60 respond to first to third switching control signals SW1, SW2, and SW3 inputted through the signal controller 30 from the timing controller to output the pixel data from the latches 46. For instance, the first to third switches 56, 58, and 60 respond to the first to third switching control signals SW1, SW2, and SW3 enabled sequentially, as shown in FIG. 7, to sequentially output the R, G, and B pixel data inputted from the latches 46 to the DAC 50.

The DAC 50 converts the R, G, and B pixel data sequentially inputted from the multiplexor 48 to R, G, and B pixel voltage signals to output the converted pixel data to the demultiplexor 52.

The demultiplexor 52 outputs the R, G, and B pixel voltage signals sequentially inputted from the DAC 50 through different output lines to each of the three samplers and holders 54. To this end, the demultiplexor 52 includes fourth to sixth switches 62, 64, and 66, each of which has an input line commonly connected to an output line of the DAC 50 and an output line connected to each of the three samplers and holders 54. The fourth to sixth switches 62, 64, and 66 respectively respond to the first to third switching control signals SW1, SW2, and SW3 inputted through the signal controller 30 from the timing controller to output the pixel data from the DAC 50 through different output lines. In this case, the demultiplexor 52 uses the first to third switching control signals SW1, SW2, and SW3 like the multiplexor 48. For instance, the fourth to sixth switches 62, 64, and 66 respond to the first to third switching control signals SW1, SW2, and SW3 sequentially enabled, as shown in FIG. 7, to separately apply the R, G, and B pixel voltage signals sequentially inputted from the DAC 50 to the three samplers and holders 54.

The three samplers and holders 54 sample and hold the R, G, and B pixel voltage signals sequentially inputted from the demultiplexor 52 and then simultaneously output to each of the first to third data lines DL1 to DL3. To this end, the sampler and holder 54 includes seventh and eighth switches 68 and 70 each of which has an input line commonly connected to one output line of the demultiplexor 52, first and second capacitors Ca and Cb connected to the output lines of the seventh and eighth switches 68 and 70, respectively, and ninth and tenth switches 72 and 74 each of which has an input line connected to each output line of the seventh and eighth switches 68 and 70 and an output line commonly connected to one of the data line DL. Further, the sampler and holder 54 includes a buffer 76 connected between the output lines of the ninth and tenth switches 72 and 74 and the data line DL.

The seventh and tenth switches 68 and 74 positioned in a diagonal direction respond to the same fourth switching control signal SW4, whereas the eighth and ninth switches 70 an 72 respond to the fifth switching control signal SW5 having a logical state opposite to the fourth switching control signal SW4. The fourth and fifth switching control signals SW4 and SW5 are applied through the signal controller 30 from the timing controller in similar to other control signals. The first and second capacitors Ca and Cb charge data on the horizontal lines different from each other, that is, adjacent to each other on a time basis.

For instance, in one horizontal period, the seventh and tenth switches 68 and 74 are turned on in response to the fourth switching control signal SW4 having a high state, as shown in FIG. 7. Thus, the pixel voltage signals applied from the demultiplexor 52 are sampled by means of the turned-on seventh switch 68 and charged and held in the first capacitor Ca. At the same time, the pixel voltage signals charged in the second capacitor Cb in the previous horizontal period are applied through the turned-on tenth switch 74 and the buffer 76, to the corresponding data line DL.

In the next horizontal period, the eighth and ninth switches 70 and 72 are turned on in response to the fifth switching control signal SW5 having a high state, as shown in FIG. 7. Thus, the pixel voltage signals applied from the demultiplexor 52 are sampled by means of the turned-on eighth switch 70 and charged and held in the second capacitor Cb. At the same time, in the previous horizontal period, the pixel voltage signals having been charged in the first capacitor Ca are applied to the corresponding data line DL through the turned-on ninth switch 72 and the buffer 76.

As described above, the sampler and holder 54 includes a pair of seventh and eighth switches 68 and 70 for sampling the pixel voltage signals, a pair of first and second capacitors Ca and Cb for charging the pixel voltage signals, and a pair of ninth and tenth switches 72 and 74 for holding the pixel voltage signals to be driven alternately, thereby preventing a signal delay caused by such sampling and holding operations.

As described above, in the data driving IC according to the present invention, the number of DAC's are reduced to at least ⅓ by a time-divisional driving of the DAC part, thereby reducing a space occupied by the DAC part within the IC. Accordingly, the number of data lines driven by the data driving IC is increased. In other words, the number of output channels becomes twice of the previously known device while a chip area is not greatly increased or reduced in comparison to the existing chip area. Thus, the number of data driving IC's and TCP's mounted with the IC's may be reduced to ½.

Figure 8:
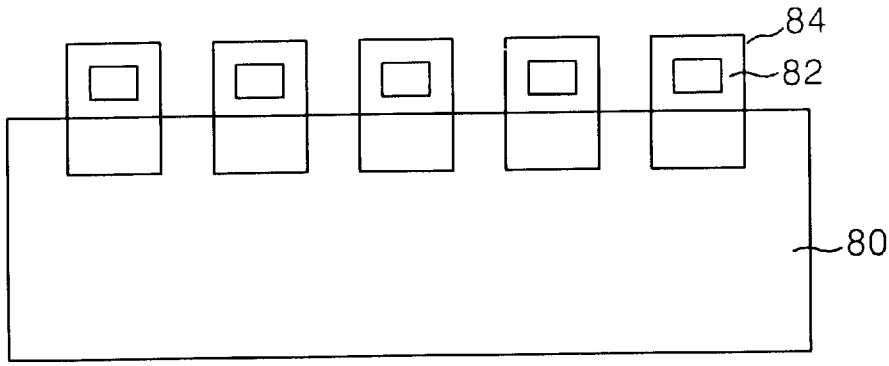
FIG. 8 is a schematic view showing a configuration of a data driving apparatus of a liquid crystal display including the data driving integrated circuit according to the present invention.

More specifically, the data driving IC's 82 having twice the output channels of the conventional device are mounted on the TCP's 84 and connected to a liquid crystal display panel 80, as shown in FIG. 8.

For example, to drive the liquid crystal display panel 80 with a SXGA (1280×1024) mode, the conventional device needs 10 data driving IC's each having 384 channels, whereas the present invention requires only 5 data driving IC's 82, which is ½ of the conventional device because 768 channels are available without an enlargement of the chip area. Accordingly, the number of data driving IC's 82 and TCP's 84 is reduced to at least ½ in comparison to the conventional device, thereby lowering manufacturing cost.

As described above, according to the present invention, the DAC part is driven on a time-division basis to increase the channel number of data driving IC's to twice of the conventional device without greatly enlarging the chip area or by reducing the chip area. Accordingly, the channel number of data driving IC's is increased and the number of data driving IC's and TCP's is reduced to ½ in comparison to the conventional device, thereby lowering manufacturing cost.

It will be apparent to those skilled in the art that various modifications and variations can be made in the apparatus and method for driving a liquid crystal display of the present invention without departing from the spirit or scope of the inventions. Thus, it is intended that the present invention covers the modifications and variations of this invention provided they come within the scope of the appended claims and their equivalents.

What is claimed is:

1. A data driving apparatus for a liquid crystal display, comprising:

a multiplexor part having x multiplexors for performing a time-division of 2n input pixel data to output the time-divided pixel data, n being a positive integer and x being a positive integer less than 2n;

a digital to analog converter part having x digital to analog converters for converting the time-divided pixel data from the demultiplexor part into pixel voltage signals;

a demultiplexor part having x demultiplexors for selectively supplying the pixel voltage signals from the digital to analog converter part to a plurality of output lines of the demultiplexor part; and a sampler and holder part having 2n samplers and holders for sampling and holding the pixel voltage signals from the demultiplexor part to substantially simultaneously output the sampled and held pixel voltage signals to 2n data lines of the liquid crystal display.

2. The data driving apparatus according to claim 1, wherein x is 2n/3, such that the multiplexor part includes 2 n/3 multiplexors to perform a 2 n/3 time-division of 2 n pixel data, the digital to analog converter part includes 2 n/3 digital to analog converters to convert 2 n/3 pixel data into the pixel voltage signals, and the demultiplexor part includes the 2 n/3 demultiplexors to selectively supply each 2 n/3 pixel voltage signals to 2 n output lines of the demultiplexor part.

3. The data driving apparatus according to claim 1, further comprising:

a shift register part for sequentially generating a plurality of sampling signals;

a latch part for sequentially latching at least 2 n pixel data by a unit in response to the sampling signals to simultaneously output the latched data to the multiplexor part; and a buffer part for buffering the pixel voltage signals from the sampler and holder part to output the buffered pixel voltage signals to the plurality of data lines of the liquid crystal display.

4. The data driving apparatus according to claim 1, wherein each digital to analog converter includes a positive part for converting the pixel data into positive voltage signals, a negative part for converting the pixel data into negative voltage signals, and a multiplexor for selecting outputs of the positive and negative parts.

5. The data driving apparatus according to claim 1, wherein each multiplexor includes first to third switching devices for performing a time-division of at least three pixel data to output the time-divided pixel data to one of the digital to analog converters in response to first to third switching control signals, respectively, and each demultiplexor includes fourth to sixth switching devices for selectively supplying the pixel voltage signals from the digital to analog converter to at least three output lines in response to the first to third switching control signals, respectively.

6. The data driving apparatus according to claim 1, wherein each sampler and holder includes:

first and second sampling switches connected in parallel to each output line of the demultiplexor part;

first and second capacitors for charging the pixel voltage signals passing through the sampling switches; and first and second holding switches for holding the pixel voltage signals charged in the first and second capacitors and discharging the held pixel voltage signals into the data lines of the liquid crystal display.

7. The data driving apparatus according to claim 6, wherein the first sampling switch for sampling the pixel voltage signals to be charged in the first capacitor and the second holding switch for holding and discharging the pixel voltage signals charged in the second capacitor are driven in response to a first switching control signal, and the second sampling switch for sampling the pixel voltage signals to be charged in the second capacitor and the first holding switch for holding and discharging the pixel voltage signals charged in the first capacitor are driven in response to a second switching control signal having a logical state inverted with respect to the first switching control signal.

8. A data driving method for a liquid crystal display, comprising:

performing a time-division of 2n input pixel data inputted to a multiplexor part having x multiplexors to apply the time-divided pixel data, n being a positive integer and x being a positive integer less than 2n;

converting the time-divided pixel data from the multiplexor part into a plurality of pixel voltage signals;

selectively supplying the pixel voltage signals from a digital to analog converter part to a demultiplexor part having x demultiplexors; and sampling and holding the pixel voltage signals from the demultiplexor part at a sampler and holder part having 2n samplers and holders to substantially simultaneously output the sampled and held pixel voltage signals to 2n data lines of the liquid crystal display.

9. The data driving method according to claim 8, further comprising:

sequentially generating a plurality of sampling signals;

sequentially latching at least 2 n pixel data by a unit in response to the sampling signals to simultaneously output the latched data to the multiplexor part; and buffering the sampled and held pixel voltage signals to output the buffered pixel voltage signals to the 2 n data lines of the liquid crystal display.

10. The data driving method according to claim 8, wherein the performing a time-division of the 2n input pixel data includes performing a time-division of the 2n input pixel data into at least three regions in response to first to third switching control signals, and the selectively supplying the pixel voltage signals includes selectively supplying the pixel voltage signals to at least three output lines in response to the first to third switching control signals.

11. The data driving method according to claim 8, wherein each of the one sampler and holder includes first and second sampling switches, first and second capacitors, and first and second holding switches.

12. The data driving method according to claim 11, wherein the sampling and holding the pixel voltage signals includes allowing the first sampling switch to sample the pixel voltage signals from the demultiplexor part to be charged in a first capacitor in one horizontal period and, at the same time, allowing the second holding switch to discharge the pixel voltage signals in a previous horizontal period charged in the second capacitor into a corresponding data line, and allowing the second sampling switch to sample the pixel voltage signals from the demultiplexor part to be charged in a second capacitor and, at the same time, allowing the first holding switch to discharge the pixel voltage signals in a previous horizontal period charged in the first capacitor to a corresponding data line.

13. The data driving apparatus according to claim 7, wherein logic states of the first and second switching control signals are respectively inverted at about a beginning of a horizontal period.

14. The data driving method according to claim 8, wherein the sampling and holding the pixel voltage signals includes:

respectively inverting logic states of first and second switching control signals at about a beginning of a horizontal period, such that during the horizontal period, the first switching control signal having a logical state inverted with respect to the second switching control signal; and controlling first and second sampling switches connected in parallel to each output line of the demultiplexor part using the first and second switching control signals to selectively sample the pixel voltage signals to be charged in one of a first capacitor and a second capacitor in each of the 2n samplers and holders.

* * * * *